US005181469A

United States Patent [19]

Merkel et al.

[11] Patent Number: 5,181,469

[45] Date of Patent: Jan. 26, 1993

[54] CLAMPING AND TENSIONING DEVICE

[75] Inventors: Gerd Merkel, Dielheim; Wilfried Vogt, Walldorf; Georg Glaunsinger, Meckesheim; Peter Stadler; Claus-Peter Zander, both of Heidelberg; Jürgen Maass; Gernot Schmitt, both of Wiesloch; Thomas Necker, Sandhausen; Willi Becker, Bammental, all of Fed. Rep. of Germany

[73] Assignee: Heidelberger Druckmaschinen AG, Heidelberg, Fed. Rep. of Germany

[21] Appl. No.: 815,419

[22] Filed: Dec. 31, 1991

[30] Foreign Application Priority Data

Dec. 31, 1990 [DE] Fed. Rep. of Germany ..... 4042293
Apr. 9, 1991 [DE] Fed. Rep. of Germany ..... 4111453
Aug. 31, 1991 [DE] Fed. Rep. of Germany ..... 4128994

[51] Int. Cl.[5] ..... B41F 27/06; B41F 27/12; B41F 7/22

[52] U.S. Cl. ..... 101/415.1

[58] Field of Search ..... 101/415.1, 378, 409, 101/410–412, 475

[56] References Cited

U.S. PATENT DOCUMENTS 3,625,151 12/1971 Hart ..... 101/415.1
3,738,268 6/1973 Swordy ..... 101/415.1

FOREIGN PATENT DOCUMENTS 0431715 6/1991 European Pat. Off. .
3010301 9/1981 Fed. Rep. of Germany .

*Primary Examiner*—J. Reed Fisher
*Attorney, Agent, or Firm*—Herbert L. Lerner; Laurence A. Greenberg

[57] ABSTRACT

A clamping and tensioning device for clamping a printing plate on a cylinder of a printing machine includes a tensioning bar and a clamping bar having substantially radially extending, mutually opposing clamping surfaces for gripping therebetween a bent end of a printing plate, the tensioning bar being formed as a pivotal double lever, tension spring devices engageable with the tensioning bar for applying a tensioning force thereto in a tensioning direction, adjusting devices engageable with the tensioning bar and actuatable for pivoting the tensioning bar against the tensioning force applied by the tension spring devices, the clamping bar being formed as a pivotal double lever connected to the tensioning bar, clamping spring devices engaging with the clamping bar for pressing the clamping surface of the clamping bar against the corresponding clamping surface of the tensioning bar with a clamping force for holding a printing plate therebetween, the clamping bar being further formed with a holding element, a fixed stop cooperatively engageable by the holding element for pivoting the clamping bar against the force of the clamping spring devices when the adjusting devices are actuated.

27 Claims, 5 Drawing Sheets

CLAMPING AND TENSIONING DEVICE

The invention relates to a clamping and tensioning device for clamping a printing plate on a cylinder of a printing machine.

From German Published, Non-Prosecuted Patent Application (DE-OS) 30 10 301, a clamping and tensioning device is known wherein one bar is pressed against another by an eccentric shaft with a printing plate clamped therebetween. In this clamping and tensioning device, tension adjustment screws serving as a tensioning device are tightened by a pressman until the required plate tension is attained.

With such a clamping and tensioning device, when changing a printing plate, it is necessary that the operator actuate the eccentric shaft by means of a tool, for example, a mandrel. No defined clamping force can be set, when the printing plate is clamped, and an undefinable upward bending of the upper bar occurs. Thus, no precise, reproducible plate positioning is able to be achieved thereby. Furthermore, manual activity requiring a screw driver or spanner must be performed in order to tension the printing plate, nor can the tensioning force be set in a defined, reproducible manner.

It is accordingly an object of the invention to provide a clamping and tensioning device, by means of which a defined clamping force for clamping a printing plate as well as a defined, reproducible tensioning force can be achieved, and which also is suitable for automatic plate clamping.

With the foregoing and other objects in view, there is provided, in accordance with the invention, a clamping and tensioning device for clamping a printing plate on a cylinder of a printing machine, comprising a tensioning bar and a clamping bar having substantially radially extending, mutually opposing clamping surfaces for gripping therebetween a bent end of a printing plate, said tensioning bar being formed as a pivotal double lever, tension spring means engageable with said tensioning bar for applying a tensioning force thereto in a tensioning direction, adjusting means engageable with said tensioning bar and actuatable for pivoting said tensioning bar against the tensioning force applied by said tension spring means, said clamping bar being formed as a pivotal double lever connected to said tensioning bar, clamping spring means engaging with said clamping bar for pressing said clamping surface of said clamping bar against the corresponding clamping surface of said tensioning bar with a clamping force for holding a printing plate therebetween, said clamping bar being further formed with a holding element, a fixed stop cooperatively engageable by said holding element for pivoting said clamping bar against the force of said clamping spring means when said adjusting means are actuated.

An advantage of the invention with respect to the clamping force is that a defined force for printing plate clamping is achieved with the clamping spring means. With respect to the tensioning force for the printing plate, it is noted that a defined force which is reproducible is likewise achieved with the tension springs. No tool is needed for plate clamping; instead, it is possible to actuate the clamping and tensioning device by push-button or to utilize it in cooperation with further automation means for effecting fully automated plate clamping. Due to the bent end of the printing plate and the radially extending clamping surfaces, the clamping force is reduced, so that it is possible, in accordance with the invention, to confine the clamping and tensioning force in a device of compact construction which requires little space. No deformation occurs when clamping the printing plate, because no embossing or stamping of the printing plate for increasing the holding force is required, so that it is possible to mount a used plate in the machine anew and to print therewith. Plate clamping as well as plate tensioning occur simultaneously by the actuation of one or more simultaneously operating adjusting means, the forces being applied by springs in such a way that, in case of failure of the adjusting means, the plate clamping as well as the plate tensioning is maintained. Also, the release of the printing plate is made possible by actuation of the cooperating, remotely controllable adjusting means in response to a control signal, so that automatic removal of the printing plate can occur. Due to the fact that only simultaneously operating adjusting means can be actuated, the infeed of a single operating medium, for example, compressed air, is sufficient as a power and signal carrier to the cylinder.

In accordance with another feature of the invention, the cylinder has a cylinder block, and shaft journals are included pivotally mounting the tensioning bar in the cylinder block. A stable positioning of the tensioning bar is thus achieved thereby.

In accordance with other features of the invention, the tension spring means comprise tension springs arranged at a side of the tensioning bar proximate to the printing plate, and the adjusting means are engageable with the tensioning bar for applying a force thereto at a side thereof distal from the printing plate. The tension springs and the adjusting means can be recessed in the cylinder block and, thus, can be accommodated in a space-saving manner.

In accordance with a further feature of the invention, the device includes clamping-spring screws having screw heads and extending through the clamping bar, the clamping-spring screws being threadedly secured in the tensioning bar, the clamping spring means comprising clamping springs clamped between the clamping bar and the respective screw heads of the clamping-spring screws.

In accordance with an additional feature of the invention, the clamping bar is formed with respective bores and clamping-spring support shoulders for receiving the clamping springs. The clamping-spring screws press the tensioning bar and the clamping bar together, so that the clamping force can be adjusted by tightening the clamping-spring screws.

Further in accordance with an added feature of the invention, the device includes support means for connecting the clamping bar with the tensioning bar, the support means comprising bearing disks arranged on the tensioning bar, and corresponding counter-bearings arranged on the clamping bar.

In accordance with yet another feature of the invention, the counter-bearings arranged on the clamping bar are rollers.

In accordance with yet a further feature of the invention, the clamping bar has adjustable bearing blocks, and the bearing disks are disposed on the bearing blocks.

In accordance with yet an added feature of the invention, there are provided screw means for connecting the clamping-bar bearing blocks to the tensioning bar, adjustment screws accessible from outside the printing cylinder arranged in the tensioning bar, respective first and second adjusting wedges operatively engageable with the adjustment screws for transmitting an adjustment thereof to a bearing surface of the clamping-bar bearing blocks, respectively. This adjustment serves for an optimal clamping of the printing plate. However, this adjustment is only required when the machine is being assembled or installed or after the machine has been used for a very long time.

In accordance with yet an additional feature of the invention, there are provided screws for connecting the clamping bar to the tensioning bar, the screws having screw heads which are calotte-shaped at respective undersides thereof, the clamping bars being formed with bores through which the screws extend with play sufficient for affording a swinging movement of the clamping bar, the bores being formed with recesses corresponding with the calotte shape of the screw heads, and holding springs for continuously biasing the clamping bar into engagement with the calotte-shaped screw heads, the clamping spring means being disposed at radially inner ends of and between the clamping bar and the tensioning bar.

In accordance with another feature of the invention, there are provided screws for connecting the clamping bar to the tensioning bar, the clamping bar being formed with bores through which the screws extend, the clamping bar being also formed with calottes in vicinity of the bores, the calottes being parts of imaginary spheres having respective centers in the center of the bores, and means defining respective recesses corresponding with the calottes disposed in vicinity of the screw heads and the tensioning bar.

In accordance with a more detailed feature of the invention, the means defining the recesses in vicinity of the screw heads are formed in respective washers.

In accordance with a further feature of the invention, the connecting screws are adjustable for adjusting at least one of the clamping bar to the tensioning bar and play of the clamping bar with respect to the connecting screws, the connecting screws being also securable in the tensioning bar.

In accordance with an added feature of the invention, the fixed stop is adjustably connected to the cylinder block for adjustment. In this manner, the gap for inserting the printing plate can be adjusted by a respective adjustment of the stop. It is essential for the arrangement of the holding element and the stop that, by actuating the adjusting members, a force component is produced by which the clamping bar is swung or pivoted against the force of the clamping springs.

In accordance with further features of the invention, the adjusting means are constructed so that they are actuatable by a simple switching command. Such automatically actuatable adjusting means are, for example, in accordance with the invention, pneumatic or hydraulic adjusting members, such as one or more pneumatic or hydraulic cylinders.

In accordance with an added feature of the invention, the clamping surfaces of the tensioning and clamping bars have respective coatings of material having a high coefficient of friction.

In accordance with a more specific feature of the invention, the coating material is formed of tungsten carbide cobalt.

In accordance with an alternate feature of the invention, one of the clamping surfaces is a smooth metal surface, and the other of the clamping surfaces is formed with a cross-cut or knurl.

By means of such clamping surfaces, a printing plate may be clamped without any occurrence of deformation in the clamping region. Thus, it poses no problem to mount and use a printing plate in the machine more times than once.

In accordance with still another feature of the invention, there are provided means for adjusting the force of the tension springs. The tensioning force can thus be optimally adjusted, e.g. matched to the plate material.

In accordance with still a further feature of the invention, in respective printing units of a printing machine having a plurality of printing units, tension springs are provided in one of the printing units having a force differing from the force of tension springs in a next following printing unit to an extent that respective printing plates clamped by the device in the respective printing units have a different length corresponding to a difference in length of printing material resulting from a stretching thereof during printing. Thus, it is possible to compensate for the amount of stretching to which the material to be printed is subjected while travelling from one printing unit to the next by varying the tension of the printing plates. In this way, the printing machine may be set to produce prints with high register accuracy over the entire image area.

In order to ensure precise clamping of the printing plate in the clamping and tensioning device, there are included, in accordance with the invention, at least two sensors arranged at the tensioning bar for detecting whether the bent end of the printing plate completely engages a front edge of the tensioning bar. A message as to the precise abutment of the printing plate against the tensioning bar can be transmitted to the pressman or to an automatic control device.

In accordance with still an added feature of the invention, the tensioning bar and the clamping bar are divided into parts, each of the parts of the tensioning bar being mounted in the cylinder block, each of the parts of the clamping bar corresponding to a respective part of the tensioning bar and being mounted on the clamping bar.

In accordance with an additional detail of the invention, each of the parts of the clamping bar corresponding to a respective part of the tensioning bar is further subdivided. With this construction, it is understood that each part must be equipped with tension springs, clamping springs, a holding element and at least one adjusting member.

In accordance with yet another detail of the invention, at least the parts of the tensioning bar disposed at outer axial ends of the printing cylinder are adjustable in axial direction of the printing cylinder. In this manner, it is possible to spread out or stretch the printing plate in one or the other direction, so as to attain a position precisely in register. The axial adjustability can occur manually or automatically by means of an additional adjusting member.

In accordance with a concomitant feature of the invention, a force-amplifying lever bearing against the cylinder block is engaged by the adjusting means for introducing an amplified force to the tensioning bar. An advantage of this feature is that stronger clamping and tensioning forces can be achieved, although the available pressure from comprised air at the printing machine is limited. Low air pressure also provides the advantage that limited demands will be made on a rotary transmission of compressed air between the machine frame and the cylinder.

Other features which are considered as characteristic for the invention are set forth in the appended claims.

Although the invention is illustrated and described herein as embodied in a clamping and tensioning device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
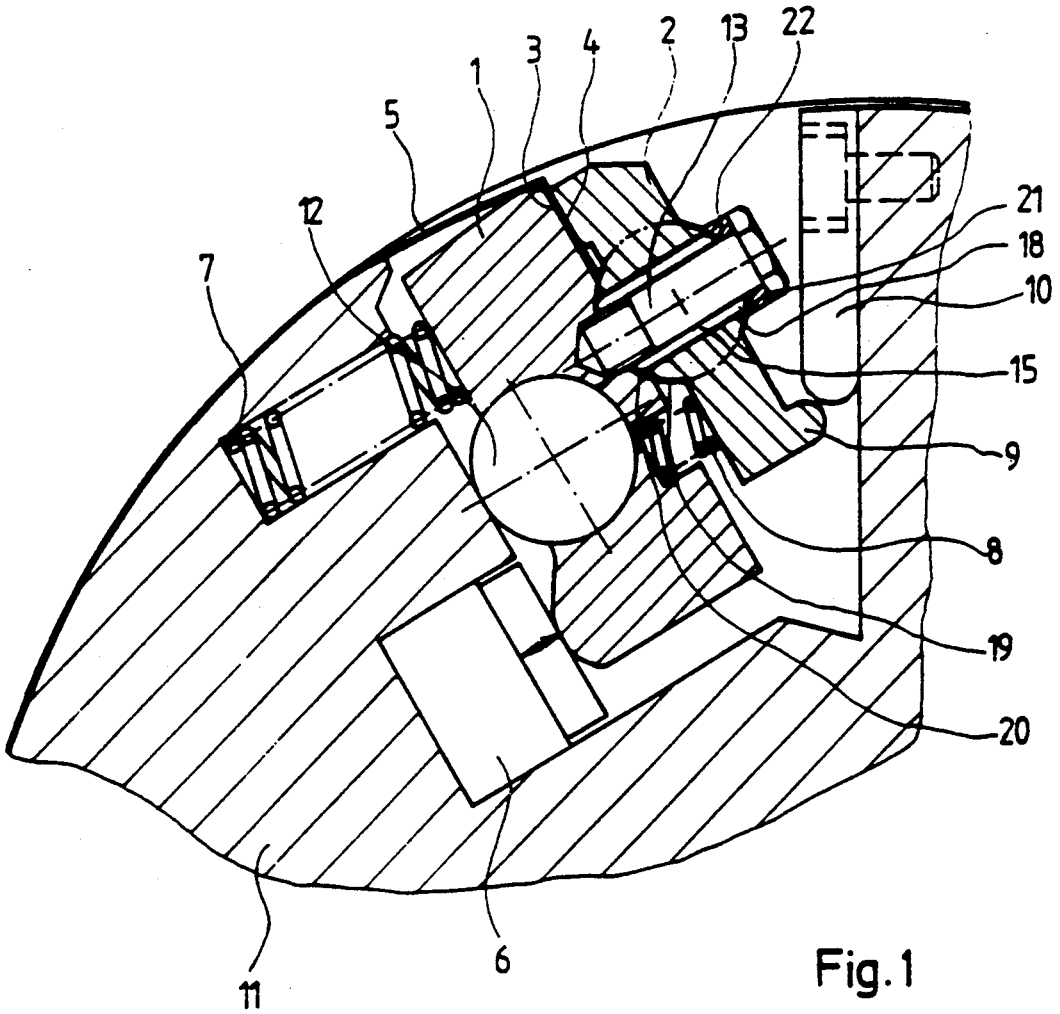
FIG. 1 is a radial cross-sectional view of a plate cylinder provided with a clamping and tensioning device according to the invention wherein a printing plate is clamped.

Referring now to the drawings and, first, particularly to FIG. 1 thereof, there is shown therein an embodiment of the clamping and tensioning device according to the invention with a printing plate 5 clamped thereon. A tensioning bar 1 is mounted on a shaft 12 which is arranged in the cylinder block 11. It is also possible to provide the tensioning bar 1 with shaft journals. A swinging or pivoting motion can be performed either by the shaft 12 or by the tensioning bar 1 swingably or pivotably mounted thereon. At a radially outer end of the tensioning bar 1, which is formed as a swingable double lever, tension springs 7 are disposed braced against the cylinder block 11. At a radially inner end of the tensioning bar 1, an adjustment mechanism or adjusting means 6 are provided which are also braced against the cylinder block 11.

Figure 2:
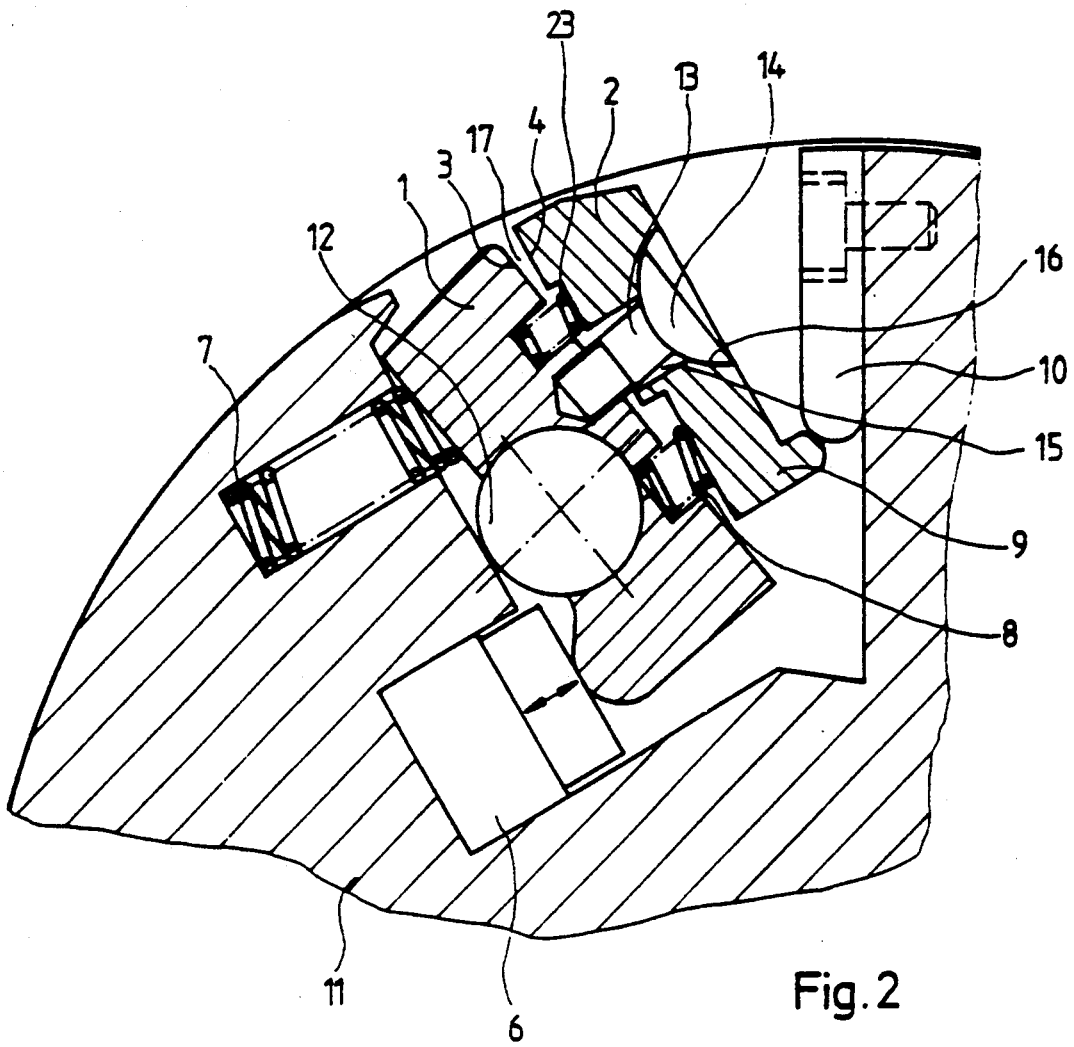
FIG. 2 is a view similar to that of FIG. 1 of another embodiment of the clamping and tensioning device which, however, provides a different way of connecting respective clamping and tensioning bars thereof and, furthermore, is shown at a phase wherein it stands ready for receiving a printing plate.

Due to the actuation of the adjustment mechanism 6, the tensioning bar 1 is swingable or pivotable against the force of the tension springs 7. This adjustment mechanism 6 can be constructed as one or more hydraulic or pneumatic cylinders. For practical purposes, the tension springs 7 are provided with a non-illustrated adjustment device, by means of which the tensioning force of the springs 7 is adjustable. A clamping bar 2 also is constructed as a swingable or pivotal double lever and is connected with the tensioning bar 1 so that it also can perform a swinging movement. At its radially outer end, the clamping bar 2 is formed with a clamping surface 4 which cooperates with a corresponding clamping surface 3 formed on the tensioning bar 1. At the other end of the clamping bar 2, clamping springs 8 are provided which are braced against the tensioning bar 1. The clamping springs 8 load the clamping bar 2 with such a force that an optimal holding power exists between the clamping surfaces 3 and 4 for clamping the printing plate 5. A support for the clamping bar 2 is provided by screws 13 which are screwed into the tensioning bar 1. These screws 13 extend through bores 15 formed in the clamping bar 2 and providing sufficient play for the swinging movement. The clamping bar 2 is formed with calottes 18 and 19 at opposite ends of the bore holes 15 which are constructed and arranged so that they constitute parts of imaginary spheres having respective centers disposed in the center of axes of symmetry of the bores 15. In the vicinity of the screw heads as well as in the vicinity of the tensioning bar 1, recesses are formed which correspond with the shape of the calottes 18 and 19. The corresponding recesses in the vicinity of the screw heads, as shown in FIG. 1, are formed in washers 22. By suitably adjusting the screw 13, the play of the articulating joint may be adjusted. At the radially inner end of the clamping bar 2, opposite the point of attack of the clamping springs 8, a holding element 9 is provided having a spherical shape which, for swinging the tensioning bar 1, cooperates with a likewise spherical stop 10 fixedly connected with the cylinder block 11 so that the clamping bar 2 is swung against the force of the clamping springs 8, and, as shown in FIG. 2, a gap 17 is formed for receiving the printing plate 5. A fixed stop 10 is connected to the cylinder block 11 by a screw. The gap 17 for receiving the printing plate 5 can thereby be adjusted.

FIG. 2 shows another embodiment of the device according to the invention having the same principles of operation as those of the embodiment illustrated in FIG. 1, but wherein a further possible construction for connecting the clamping bar 2 with the tensioning bar 1 is presented. The clamping and tensioning device of FIG. 2 is shown in a ready-position for receiving a non-illustrated printing plate. The gap 17 mentioned hereinbefore serves for receiving the printing plate.

The connection of the clamping bar 2 with the tensioning bar 1, in the embodiment of FIG. 2, is also effected by screws 13 and bores 15, the screws 13 carrying, at the underside thereof, calotte-shaped screw heads 14 seated or mounted in recesses 16 formed in the clamping bar 2 and having a corresponding calotte shape. Holding springs 17 which are weaker than the clamping springs 8 and are disposed between the clamping surface 4 and the screws 13 ensure engagement of the clamping bar 2 with the calotte-shaped screw heads 14. The swinging movement thereby receives reliable guidance. By adjusting the screws 13, the position of the clamping bar 2 with respect to the tensioning bar 1 may be adjusted.

The function of the clamping and tensioning device can be clearly recognized from FIGS. 1 and 2. FIG. 1 shows the adjustment mechanism 6 in a withdrawn position wherein the clamping springs 8 provide the clamping force for clamping the printing plate 5 between the clamping surfaces 3 and 4. The tension springs 7 press against the tensioning bar 1, so that the printing plate 5 experience the required tension.

To remove the printing plate 5, the adjustment mechanism 6 is activated and moved into the position thereof shown in FIG. 2. The tension springs 7 are thus compressed and the holding element 9 is driven against the fixed stop 10, whereby the clamping springs 8 are likewise compressed. The clamping surface 3 accordingly moves in a path towards the left-hand side of FIG. 2, this path being longer than the path traveled by the clamping surface 4 because the clamping bar 2 with the holding element 9 engages the stop 10, and the gap 17 is thereby widened for receiving the printing plate. With such an adjustment movement of the adjustment mechanism 6, the printing plate 5 is loosened and simultaneously released from its clamped position between the clamping surfaces 3 and 4, and is easily removable.

When a printing plate 5 is to be inserted anew into the clamping and tensioning device, this plate is inserted with its bent end into the gap 17, and the adjustment mechanism 6 is then withdrawn, so that the gap 17 initially closes with the printing plate 5 clamped between the clamping surfaces 3 and 4, and then the tension springs 7 are released for achieving the required tensioning of the plate 5. The closing of the gap 17 occurs due to the release of the holding element 8 from the stop 10. With a completely clamped printing plate 5, as illustrated in FIG. 3, the adjustment mechanism 6 can be completely withdrawn, because the clamping springs 8 effect the required clamping of the printing plate 5 without any supply of energy, and the tension springs 7 provide for the necessary plate tension.

Figure 3:
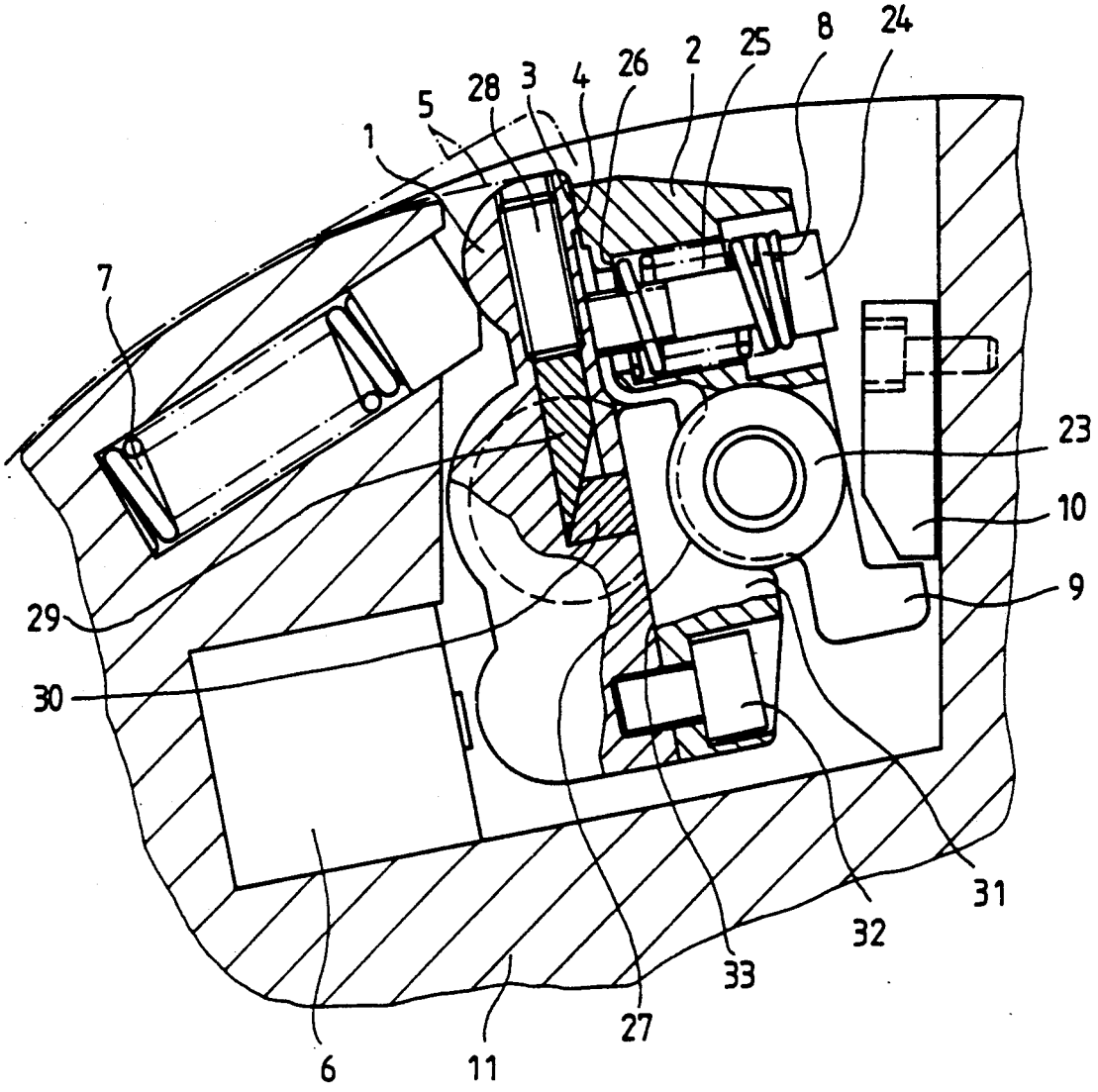
FIG. 3 is a view like those of FIGS. 1 and 2 of a further embodiment of the invention provided with an adjustment mechanism.

The embodiment of the clamping and tensioning device further illustrated in FIG. 3 has clamping springs 8 and a support of the clamping bar 2 on the tensioning bar 1 which are different in construction from those shown in FIGS. 1 and 2. Also, this construction of FIG. 3 provides means for adjusting the support of the clamping bar 2 on the tensioning bar 1. Parts in the embodiment of FIG. 3 which are like those of the embodiments of FIGS. 1 and 2 are identified by the same reference numerals, and the function thereof corresponds to the description hereinbefore.

The clamping springs 8 are disposed, facing towards the printing plate 5, on that side of the clamping bar 2, with respect to the pivot axis of the clamping bar 2, which is located adjacent the bend in the plate 5 and, in fact, are inserted between the clamping bar 2 and clamping spring screws 24 screwed into the tensioning bar 1. This insertion is possible because the clamping bar 2 is formed with a bore 25 for receiving therein the clamping spring screws 24 and the clamping springs 8, the bore 25 being a clamping spring bore having a narrow portion with a shoulder 26 for supporting the clamping springs 8. The smaller-diameter part of the bore located below the clamping-spring support shoulder 26 serves as a pass-through for the clamping spring screws 24 which are screwed into the tensioning bar located therebelow. With this arrangement of the clamping springs 8, the spring tension can be adjusted by means of the clamping spring screws 24 in a relatively simple manner. The clamping springs 8 are mounted in the clamping bar 2 and are thereby protected from soiling. As to the function thereof, the thus arranged clamping springs 8 also provide the tensioning force for the printing plate 5 in that they press the tensioning bar 1 and the clamping bar 2 together. In this embodiment of FIG. 3, too, the clamping springs 8 are pressed together, as the gap widens for receiving a printing plate, due to the cooperation of the fixed stop 10 with the holding element 9 in the described manner, when the adjustment mechanism 6 is actuated.

The support for the connection of the clamping bar 2 with the tensioning bar 1 is formed of bearing disks 27 arranged on the tensioning bar 1 and corresponding with abutments or counter-bearings on the clamping bar 2. The embodiment according to FIG. 3 provides for these abutments or counter-bearings to be constructed as rollers 23 and for the bearing disks 27 to be arranged on adjustable clamping-bar bearing blocks 31. These clamping-bar bearing blocks 31 are connected to the tensioning bar 1 by screws 32.

The adjustment takes place by providing that adjustment screws 28 which are accessible from the outside, i.e., from the side of the cylinder jacket, are arranged in the tensioning bar and these adjustment screws 28 press against a first adjusting wedge 29 which, with its wedge-shaped surface, applies pressure to a wedge-shaped surface of a second adjusting wedge 30 through which this adjustment is transmitted with a deflection of about 90° and, thereby, the adjustment is applied to the support surface 33 of the clamping-bar bearing block 31. This causes a slight opening or closing of the gap between the tensioning bar 1 and the clamping-bar bearing block 31, the adjustment being within the elastic range of the material. In this manner, an adjustment in both directions is made possible.

Figure 4:
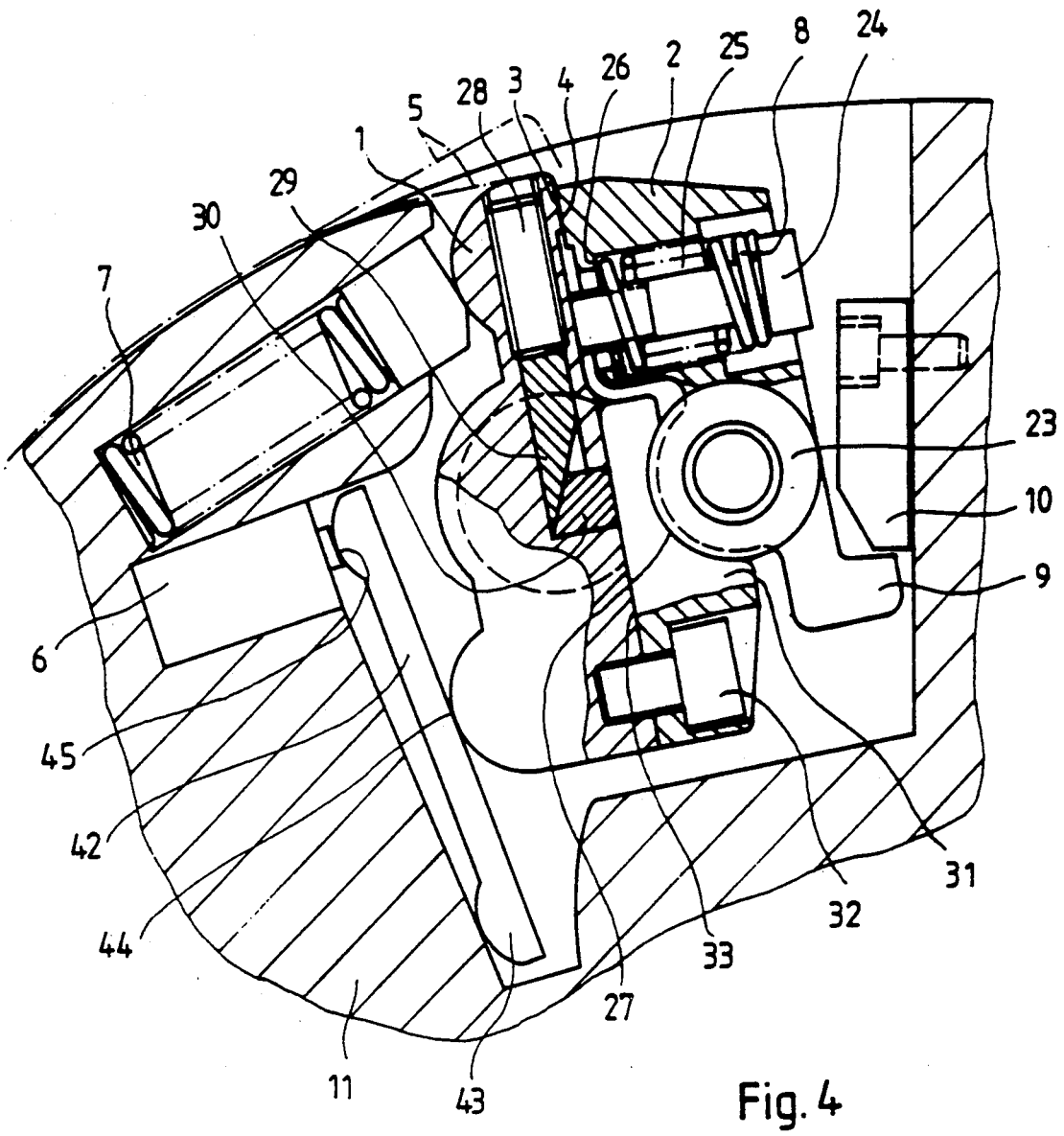
FIG. 4 is a view of the embodiment according to FIG. 3 provided additionally with a device for amplifying the force applied by the adjustment mechanism.

FIG. 4 illustrates an embodiment such as is shown in FIG. 3, however, including a device for amplifying the force of the adjustment element in order to achieve stronger plate tensioning and plate clamping. Greater force is introduced by the adjustment mechanism 6 to the tensioning bar 1 through the intermediary of a force-amplifying lever 42, in order to be able to adjust the tensioning bar 1 also against stronger tension springs 7 and clamping springs 8. Such a force amplifying lever 42 which effects a twofold increase of force is illustrated in FIG. 4. At one end of the lever 42, the introduction of force at 44 is effected by the adjustment mechanism 6 and, at the other end of the lever 42, a seat 43 is provided resting on the cylinder block 11. The introduction of force at 44 to the tensioning bar 1 occurs in the middle of the force-amplifying lever 42. Of course, the lever proportions or ratios may be selected at random, depending upon the required forces for swinging the tensioning bar 1, on the one hand, and the forces of the adjustment mechanisms 6 which are available, on the other hand.

Figure 5:
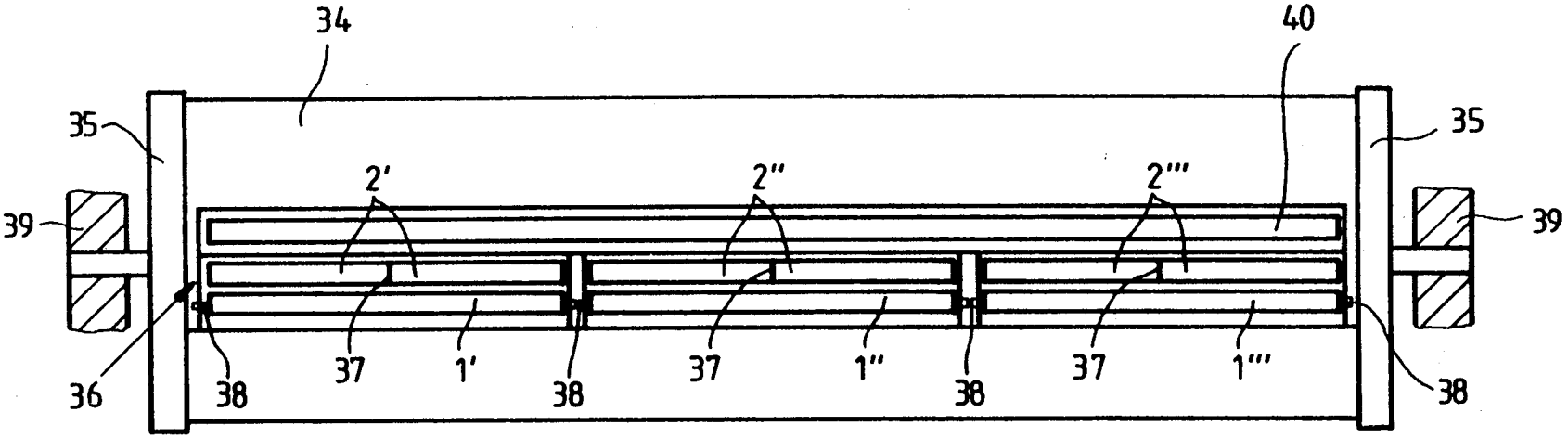
FIG. 5 is a reduced diagrammatic top plan or longitudinal view of the cylinder having divided tensioning and clamping bars, respectively.

FIG. 5 is a top plan or longitudinal view of the cylinder 34 with a divided or split tensioning bar 1 and clamping bar 2. This construction calls for the tensioning bar 1 and the clamping bar 2 to be divided or split into three respective mutually corresponding parts. The tensioning bar 1 is formed of parts 1', 1'' and 1''', each of these parts cooperating with a respective part 2', 2'' and 2''' of the clamping bar 2. The parts 2', 2'' and 2''' of the clamping bar 2 are of the same length as the respective parts 1', 1'' and 1''' of the tensioning bar 1. These parts 2', 2'' and 2''' of the clamping bar 2, however, can have an additional subdivision or split at 37, so that each part 1', 1'' and 1''' of the tensioning bar 1 cooperates with two parts of the clamping bar 2. The parts 1', 1'' and 1''' of the tensioning bar 1, are mounted, respectively, at both ends by shaft journals 38 in a gap 36 of the cylinder 34. The respective parts 2', 2'' and 2''' of the clamping bar 2 are swingably mounted on the respective parts of the tensioning bar 1. With an additional subdivision or split of the parts of the clamping bar 2, each of the nine parts must be mounted on respective parts of the tensioning bar 1. It is readily apparent that each of the parts must be provided with elements for the hereinaforedescribed functions. Of the parts 1', 1'' and 1''' of the tensioning bar 1, at least the parts 1' and 1''' located at the outer ends of the cylinder 34 are adjustable in axial direction. Thus, due to the mounting of the parts 2' and 2''' of the clamping bar 2 on the parts 1' and 1''' of the tensioning bar 1, they are adjusted in common therewith. The adjustability of the parts can be effected with screws or eccentrics or automatically by adjustment elements and serves for setting the register of printing plates which are not always flawless. In FIG. 5, there are further shown the clamping device for the forward or leading edge 40 of the printing plate cylinder bearers 35 and a bearing support for the cylinder 39.

We claim:

1. Clamping and tensioning device for clamping a printing plate on a cylinder of a printing machine, comprising a tensioning bar and a clamping bar having substantially radially extending, mutually opposing clamping surfaces for gripping therebetween a bent end of a printing plate, said tensioning bar being formed as a pivotal double lever, tension spring means engageable with said tensioning bar for applying a tensioning force thereto in a tensioning direction, adjusting means engageable with said tensioning bar and actuatable for pivoting said tensioning bar against the tensioning force applied by said tension spring means, said clamping bar being formed as a pivotal double lever connected to said tensioning bar, clamping spring means engaging with said clamping bar for pressing said clamping surface of said clamping bar against the corresponding clamping surface of said tensioning bar with a clamping force for holding a printing plate therebetween, said clamping bar being further formed with a holding element, a fixed stop cooperatively engageable by said holding element for pivoting said clamping bar against the force of said clamping spring means when said adjusting means are actuated.

2. Device according to claim 1, wherein the cylinder has a cylinder block, and including shaft journals pivotally mounting said tensioning bar in said cylinder block.

3. Device according to claim 1, wherein said tension spring means comprise tension springs arranged at a side of said tensioning bar proximate to the printing plate.

4. Device according to claim 1, wherein said adjusting means are engageable with said tensioning bar for applying a force thereto at a side thereof distal from the printing plate.

5. Device according to claim 1, including clamping-spring screws having screw heads and extending through said clamping bar, said clamping-spring screws being threadedly secured in said tensioning bar, said clamping spring means comprising clamping springs clamped between said clamping bar and the respective screw heads of said clamping-spring screws.

6. Device according to claim 5, wherein said clamping bar is formed with respective bores and clamping-spring support shoulders for receiving said clamping springs.

7. Device according to claim 1, including support means for connecting said clamping bar with said tensioning bar, said support means comprising bearing disks arranged on said tensioning bar, and corresponding counter-bearings arranged on said clamping bar.

8. Device according to claim 7, wherein said counter-bearings arranged on said clamping bar are rollers.

9. Device according to claim 7, wherein said clamping bar has adjustable bearing blocks, and said bearing disks are disposed on said bearing blocks.

10. Device according to claim 9, including screw means for connecting said clamping-bar bearing blocks to said tensioning bar, adjustment screws accessible from outside the printing cylinder arranged in said tensioning bar, respective first and second adjusting wedges operatively engageable with said adjustment screws for transmitting an adjustment thereof to a bearing surface of said clamping-bar bearing blocks, respectively.

11. Device according to claim 1, including screws for connecting said clamping bar to said tensioning bar, said screws having screw heads which are calotte-shaped at respective undersides thereof, said clamping bars being formed with bores through which said screws extend with play sufficient for affording a swinging movement of said clamping bar, said bores being formed with recesses corresponding with the calotte shape of said screw heads, and including holding springs for continuously biasing said clamping bar into engagement with said calotte-shaped screw heads, said clamping spring means being disposed at radially inner ends of and between said clamping bar and said tensioning bar.

12. Device according to claim 1, including screws for connecting said clamping bar to said tensioning bar, said clamping bar being formed with bores through which said screws extend, said clamping bar being also formed with calottes in vicinity of said bores, said calottes being parts of imaginary spheres having respective centers in the center of said bores, and including means defining respective recesses corresponding with said calottes disposed in vicinity of said screw heads and said tensioning bar.

13. Device according to claim 12, wherein said means defining the recesses in vicinity of said screw heads are formed in respective washers.

14. Device according to claim 11, wherein said connecting screws are adjustable for adjusting at least one of said clamping bar to said tensioning bar and play of said clamping bar with respect to said connecting screws, said connecting screws being also securable in said tensioning bar.

15. Device according to claim 2, wherein said fixed stop is adjustably connected to said cylinder block for adjustment.

16. Device according to claim 1, wherein said adjusting means comprise a pneumatic adjusting member.

17. Device according to claim 1, wherein said adjusting means comprise an hydraulic adjusting member.

18. Device according to claim 1, wherein said clamping surfaces of said tensioning and clamping bars have respective coatings of material having a high coefficient of friction.

19. Device according to claim 18, wherein said coating material is formed of tungsten carbide cobalt.

20. Device according to claim 1, wherein one of said clamping surfaces is a smooth metal surface, and the other of said clamping surfaces is formed with a cross-cut or knurl.

21. Device according to claim 2, including means for adjusting the force of said tension spring means.

22. Device according to claim 1, in respective printing units of a printing machine having a plurality of printing units, comprising tension springs in one of the printing units having a force differing from the force of tension springs in a next following printing unit to an extent that respective printing plates clamped by the device in the respective printing units have a different length corresponding to a difference in length of printing material resulting from a stretching thereof during printing.

23. Device according to claim 1, including at least two sensors arranged at said tensioning bar for detecting whether the bent end of the printing plate completely engages a front edge of said tensioning bar.

24. Device according to claim 2, wherein said tensioning bar and said clamping bar are divided into parts, each of the parts of said tensioning bar being mounted in said cylinder block, each of the parts of said clamping bar corresponding to a respective part of said tensioning bar and being mounted on said clamping bar.

25. Device according to claim 24, wherein each of the parts of said clamping bar corresponding to a respective part of said tensioning bar are further subdivided.

26. Device according to claim 25, wherein at least the parts of said tensioning bar disposed at outer axial ends of the printing cylinder are adjustable in axial direction of the printing cylinder.

27. Device according to claim 2, wherein a force-amplifying lever bearing against said cylinder block is engaged by said adjusting means for introducing an amplified force to said tensioning bar.

* * * * *